US006860050B2

(12) United States Patent
Flynn et al.

(10) Patent No.: US 6,860,050 B2
(45) Date of Patent: Mar. 1, 2005

(54) APPARATUS FOR SEPARATING LABEL ASSEMBLY

(76) Inventors: Timothy J. Flynn, 18 Caloosa Rd., Key Largo, FL (US) 33037; Thomas E. Flynn, 7305 Gleneagle Cir., Crystal Lake, IL (US) 60014; Patrick J. Flynn, 107 Jennifer St., Redlands, CA (US) 92373

( * ) Notice: Subject to any disclaimer, the term of this patent is extended or adjusted under 35 U.S.C. 154(b) by 0 days.

(21) Appl. No.: 10/390,339

(22) Filed: Mar. 17, 2003

(65) Prior Publication Data

US 2004/0181987 A1 Sep. 23, 2004

(51) Int. Cl.[7] ..... G09F 3/10
(52) U.S. Cl. ..... 40/638; 40/360; 283/81
(58) Field of Search ..... 40/638, 360; 283/81

(56) References Cited

U.S. PATENT DOCUMENTS

| | | | | | |
|---|---|---|---|---|---|
| 465,588 | A | | 12/1891 | Wheeler | |
| 1,500,698 | A | | 7/1924 | Wiehl | |
| 1,821,916 | A | | 9/1931 | Acheson et al. | |
| 3,226,862 | A | * | 1/1966 | Gabruk | 40/638 |
| 3,825,463 | A | * | 7/1974 | Amann | 428/41.1 |
| 4,084,015 | A | | 4/1978 | Patterson | |
| 4,215,879 | A | * | 8/1980 | Blum | 40/638 |
| 5,083,979 | A | * | 1/1992 | Burt | 462/3 |
| 5,147,699 | A | * | 9/1992 | Browning et al. | 428/40.1 |
| 5,334,432 | A | | 8/1994 | Long | |
| 5,462,783 | A | * | 10/1995 | Esselmann | 40/630 |
| 5,925,200 | A | | 7/1999 | Grossman | |
| 6,036,231 | A | * | 3/2000 | Foote et al. | 40/310 |
| 6,054,009 | A | | 4/2000 | Cote et al. | |
| 6,217,078 | B1 | * | 4/2001 | Roth et al. | 283/81 |
| 6,273,167 | B1 | | 8/2001 | Miller | |
| 6,318,436 | B1 | | 11/2001 | Hummell et al. | |
| 6,321,811 | B1 | | 11/2001 | Atkinson et al. | |
| 6,347,654 | B1 | | 2/2002 | Koch | |
| 6,363,987 | B1 | | 4/2002 | Koch | |
| 6,405,777 | B1 | | 6/2002 | Lebbad | |
| 6,408,918 | B1 | | 6/2002 | Hummell et al. | |
| 6,431,238 | B1 | | 8/2002 | Atkinson | |
| 6,649,238 | B2 | * | 11/2003 | Chess et al. | 40/638 |
| 2001/0025689 | A1 | | 10/2001 | Barnet | |
| 2003/0051383 | A1 | * | 3/2003 | Attia et al. | 40/641 |

* cited by examiner

*Primary Examiner*—Gary C. Hoge
(74) *Attorney, Agent, or Firm*—Pauley Petersen & Erickson

(57) ABSTRACT

A label assembly having a face sheet adhered to a back sheet. A separation line includes at least one first tearable line of separation extending across the face sheet and a second tearable line of separation extending across the back sheet. Each first tearable line of separation is offset with respect to the second tearable line of separation. In a method for printing a plurality of portions of the label assembly, the label assembly is routed through a printer and print is applied to a first portion of the label assembly. The first portion is separated from a second portion and the second portion is routed through a printer and print is applied to the second portion of the label assembly.

16 Claims, 3 Drawing Sheets

APPARATUS FOR SEPARATING LABEL ASSEMBLY

BACKGROUND OF THE INVENTION

1. Field of the Invention

This invention relates to a separable label assembly having a face sheet adhered to a back sheet. This invention also relates to a method for separating the label assembly and a method for printing a plurality of portions of a label assembly.

2. Discussion of Related Art

Conventional label assembly sheets have a face sheet adhered to a back sheet. Conventional label assembly sheets can be run through a printer, for printing in a first area of the label assembly sheet. The entire label assembly sheet can then be passed through the printer to print in a second area of the label assembly sheet. However, when the label assembly sheet is passed through the printer with the same edge inserted into the printer, many computer programs require manipulation to reposition the print command from the first area to the second area.

With certain computer programs or software, the print command can remain the same, without different formatting. However, conventional label assembly sheets can be routed through a printer by inserting a first end of the label assembly sheet into the printer. Without reformatting the computer program associated with the printing commands, the conventional label assembly sheet can be rotated so that a different edge of the label assembly sheet is inserted into the printer.

For example, with conventional printing methods and label assembly sheets, a label assembly sheet can be routed through a printer, and printed upon an upper half of the label assembly sheet. The label assembly sheet can then be separated into two portions. Of the two portions, a printed or spent portion can be discarded and the remaining portion can be routed through the printer, as a one-half sheet piece, for printing on the second portion of the label assembly sheet, without reformatting the computer program or software.

It is often advantageous to separate the label assembly sheet into two or more pieces, each for individual routing through a printer. For example, if a label is removed from the label assembly sheet, the adhesive can flow into unintended areas that transfer the adhesive to printer components. The undesired adhesive in the printer can cease printing operations and can also destroy the printer.

There is an apparent need for a label assembly sheet that can be easily separated, particularly without leaving rough edges and/or adhesive residue.

SUMMARY OF THE INVENTION

It is one object of this invention to provide an apparatus for separating a label assembly sheet, wherein a face sheet has one tearable line of separation which is offset with respect to a second tearable line of separation of a back sheet.

It is another object of this invention to provide a method for separating a label assembly sheet, wherein the face sheet is separated along at least one first tearable line of separation and the back sheet is separated along a second tearable line of separation which is offset with respect to the first tearable line of separation.

It is still another object of this invention to provide a method for printing a plurality of portions of a label assembly.

The above and other objects of this invention are accomplished with a label assembly that has a face sheet, a back sheet and a layer of adhesive positioned between the face sheet and the back sheet. The face sheet has at least one first tearable line of separation that extends across the face sheet. Each back sheet has a second tearable line of separation that extends across the back sheet. The first tearable line of separation is preferably offset with respect to the second tearable line of separation.

When a first portion of the label assembly is separated with respect to a second portion of the label assembly, along the separation line that divides the label assembly into at least two portions, the face sheet is separated along the first tearable line of separation and the back sheet is separated along the second tearable line of separation.

In one embodiment of this invention, each second tearable line of separation in the back sheet corresponds to two first tearable lines of separation in the face sheet. In such embodiment, the two first tearable lines of separation can be each positioned on an opposite side of the second tearable line of separation. A strip of the face sheet between the two first tearable lines of separation can be removed to expose the second tearable line of separation within the back sheet. After the strip is removed with respect to the face sheet, the back sheet can be easily separated along the second tearable line of separation.

In a method for separating the label assembly according to this invention, the face sheet is separated along the first tearable line of separation and the back sheet is separated along the second tearable line of separation. In an embodiment where a strip is formed between two first tearable lines of separation, the strip can be removed to expose the second tearable line of separation. The back sheet can then be separated into two portions.

In different embodiments according to this invention, the first tearable line of separation and/or the second tearable line of separation can include a die cut line, a laser die cut line, a score cut line, a perforation line, a microperforation line, a chemically etched line, a liquid etched line, a gas etched line and/or any other suitable tearable line of separation or line of weakening. The tearable line of separation of this invention can be laser cut and/or knife cut.

In one embodiment of this invention, in a method for printing a plurality of portions of a label assembly, the label assembly is routed through a printer and print is applied to a first portion of the label assembly. The first portion of the label assembly is separated from the second portion of the label assembly, along the first tearable line of separation and the second tearable line of separation. The second portion of the label assembly is then routed through a printer and print is applied to the second portion of the label assembly.

BRIEF DESCRIPTION OF THE DRAWINGS

The features of this invention can be better understood when the following specification is read in view of the drawings, wherein.

DETAILED DESCRIPTION OF THE PRESENTLY PREFERRED EMBODIMENTS

Figure 1:
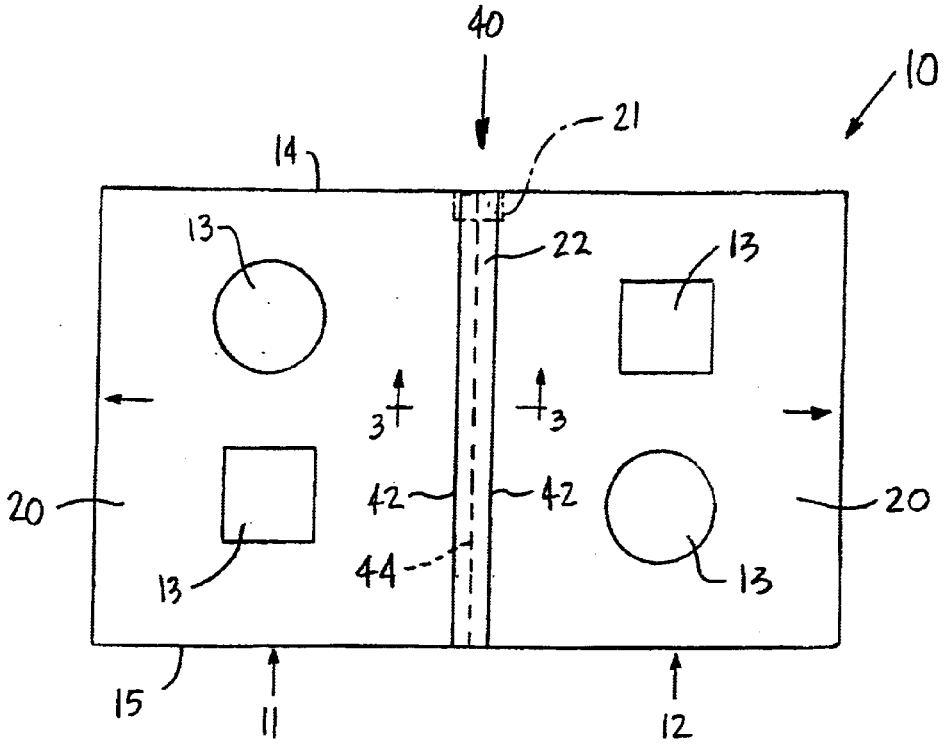
FIG. 1 is a top view of a label assembly, according to one embodiment of this invention.
Figure 2:
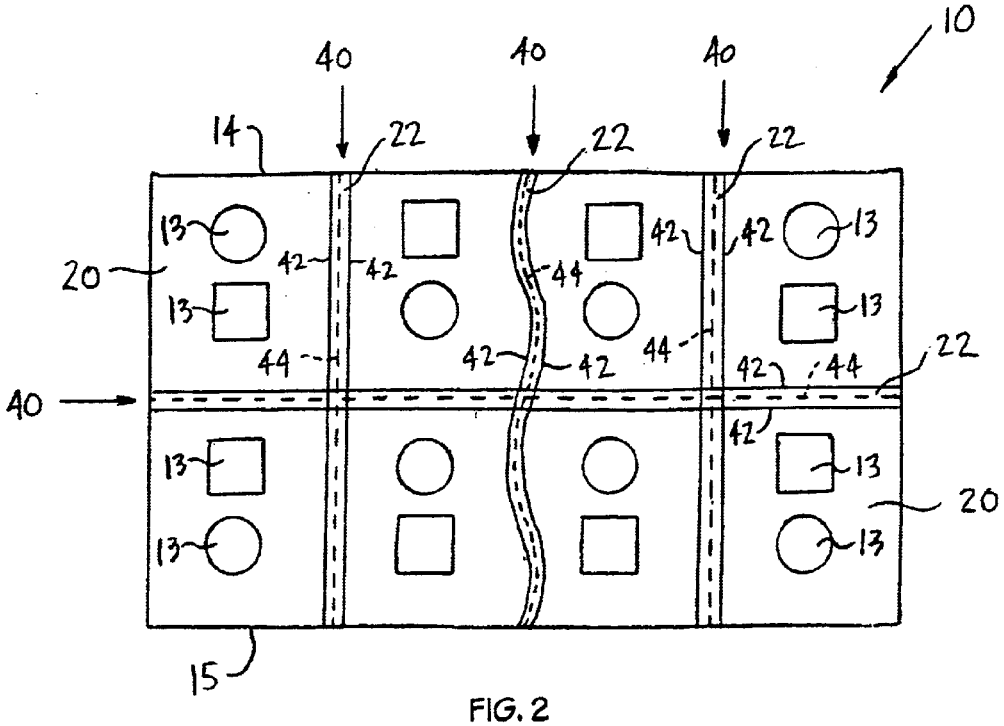
FIG. 2 is a top view of a label assembly, according to another embodiment of this invention.

FIG. 1 shows one embodiment of label assembly 10 and FIG. 2 shows a different embodiment of label assembly 10. As shown in FIG. 1, label assembly 10 can be separated along separation line 40 to divide label assembly 10 into portion 11 and portion 12. In the embodiment shown in FIG. 2, label assembly 10 can be divided into as many as eight portions. As shown in FIG. 2, four separation lines 40 are used to divide label assembly 10. It is apparent that any other suitable number of separation lines 40 can be used to divide label assembly 10 into any suitable number of equal or unequal portions.

Figure 3:
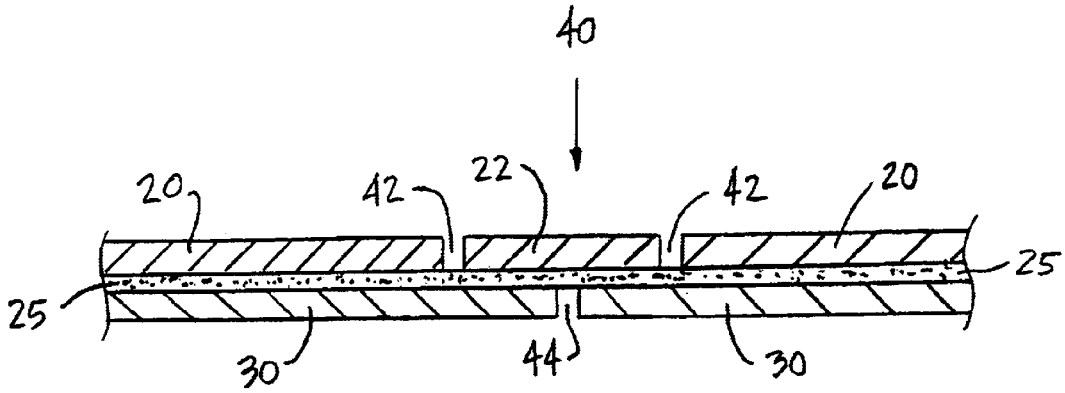
FIG. 3 is a sectional view taken along line 3—3, as shown in FIG. 1, showing a face sheet adhered to a back sheet.
Figure 4:
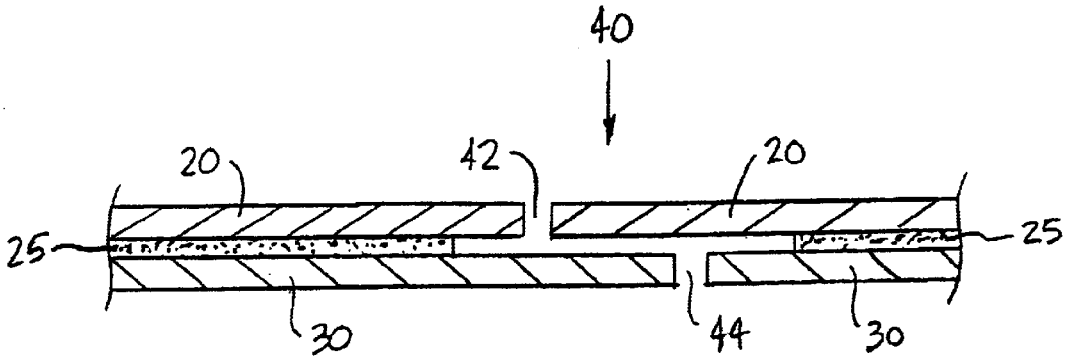
FIG. 4 is a sectional view taken in a similar direction as shown in FIG. 3, but according to another embodiment of this invention.

As shown in FIGS. 3 and 4, a layer of adhesive 25 is positioned between face sheet 20 and back sheet 30. Adhesive 25 adheres to face sheet 20 more than it adheres to back sheet 30. This feature allows face sheet 20 to be removed with respect to back sheet 30, so that the adhesive 25 adheres to face sheet 20, for example to form an adhesive label.

Face sheet 20 and back sheet 30 are preferably but not necessarily coextensive with respect to each other. In other embodiments of this invention, face sheet 20 can have different dimensions and/or different shapes, as compared to back sheet 30.

As shown in FIGS. 1–4, separation line 40 is used to divide label assembly 10 into at least two portions 11 and 12. In one embodiment of this invention, separation line 40 comprises at least one tearable line 42 extending across face sheet 20 and tearable line 44 extending across back sheet 30. FIG. 3 shows separation line 40 comprising two tearable lines 42 and one tearable line 44. FIG. 4 shows another embodiment where separation line 40 comprises one tearable line 42 and one tearable line 44.

As shown in FIGS. 3 and 4, each tearable line 42 is offset with respect to tearable line 44. As shown in FIG. 3, adhesive layer 25 extends entirely across separation line 40. As shown in FIG. 4, adhesive layer 25 stops short of and surrounds separation line 40, so that there is no adhesive at or around tearable line 42 and/or tearable line 44.

As used throughout this specification and in the claims, the phrase tearable line and/or the phrase tearable line of separation is intended to relate to a line of weakening of the structure of face sheet 20 and/or back sheet 30. The line of weakening has a weakened structural area along which face sheet 20 and/or back sheet 30 can be separated. Each tearable line or line of weakening, according to this invention, comprises at least one of a die cut line, a laser die cut line, a score cut line, a perforation line, a microperforation line, a chemically etched line, a liquid etched line and/or a gas etched line. Tearable line 42 and/or tearable line 44 of this invention may comprise any other suitable separation line or line of weakening known to those skilled in the art of label assemblies.

As shown in FIG. 1, separation line 40 comprises two tearable lines 42, each positioned on a different side of tearable line 44. Removable strip 22 is formed between both tearable lines 42. As shown in FIG. 1, strip 22 can be removed to expose tearable line 44. When strip 22 is removed with respect to face sheet 20 and/or back sheet 30, portion 11 of label assembly 10 can be easily separated from portion 12 of label assembly 10.

As shown in FIG. 1, lift tab 21 can be formed as part of strip 22. Lift tab 21 simplifies the method step of removing strip 22 from label assembly 10. In one embodiment of this invention, adhesive 25 is positioned between face sheet 20 and back sheet 30 at the area defined by lift tab 21. In another embodiment of this invention, adhesive layer 25 surrounds the area defined by lift tab 21, between face sheet 20 and back sheet 30, so that lift tab 21 is easily removed from a non-adhesive area with respect to back sheet 30.

As shown in FIG. 1, tearable line 44 intersects lift tab 21. This arrangement also simplifies the step of removing strip 22 with respect to back sheet 30.

Figure 5:
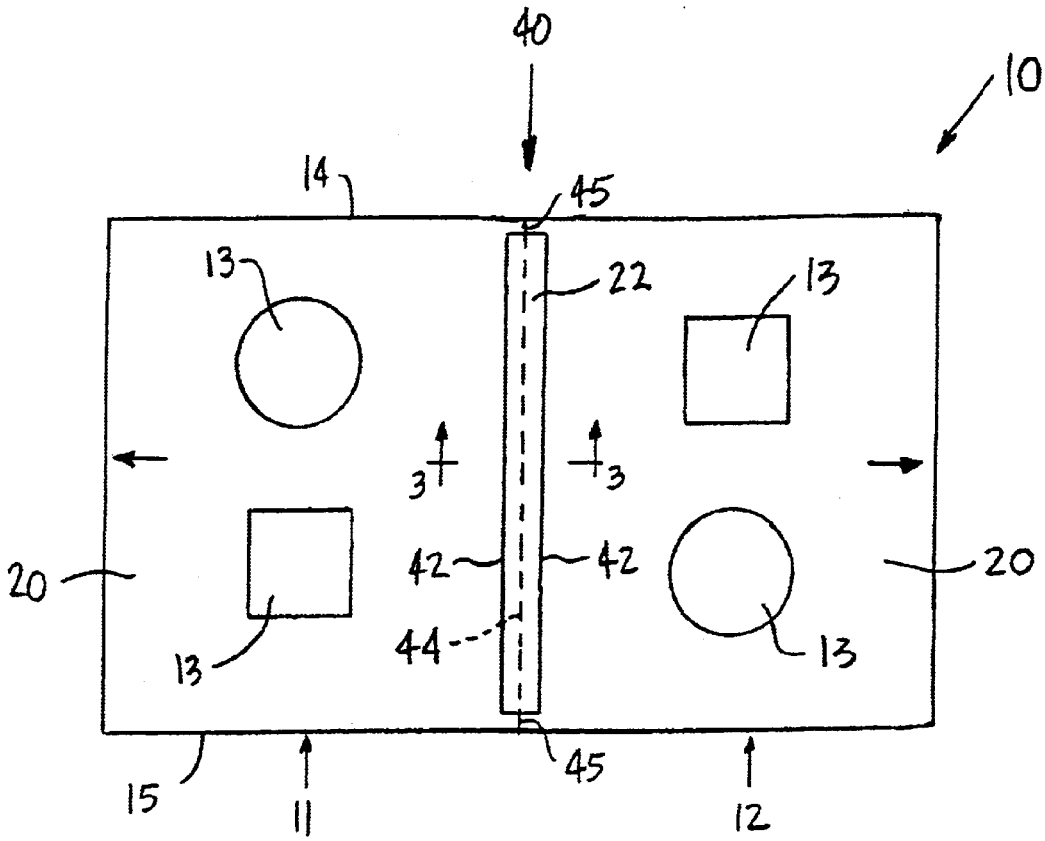
FIG. 5 is a top view of a label assembly, according to another embodiment of this invention.

In one embodiment of this invention, each tearable line 42 and 44 extends from edge portion 14 to edge portion 15, each of label assembly 10. In another embodiment of this invention, such as shown in FIG. 5, tearable line 42 and/or tearable line 44 stop short of edge portion 14 and/or edge portion 15. Tearable line 42 and/or tearable line 44 can stop short of or can extend all of the way to edge portion 14 and/or edge portion 15, depending upon the particular design of label assembly 10. As shown in the embodiment of FIG. 5, tearable line 42 stops short of both edge portions 14 and 15, and tearable line 45 is positioned between the end of tearable line 44 and each of edge portions 14 and 15. This embodiment provides structure that adds strength to label assembly 10, so that label assembly 10 can be routed through rollers and other mechanical handlers, during a printing process or when manufacturing the labels, without breaking apart.

In one embodiment of this invention, a path of tearable line 42 generally follows a path of tearable line 44. As shown in FIG. 1, each tearable line 42 and tearable line 44 are linear. In another embodiment as shown in FIG. 2, at least one separation line 40 follows a non-linear path. As shown in FIG. 2 the central vertical separation line 40 comprises two non-linear tearable lines 42 and one non-linear tearable line 44. Any tearable line 42 and/or tearable line 44 can have a linear and/or non-linear path, depending upon the particular design of label assembly 10.

In a method for separating label assembly 10, according to this invention, face sheet 20 is separated along at least one tearable line 42 and back sheet 30 is separated along tearable line 44 which is offset with respect to tearable line 42. In one embodiment of this invention, strip 22 of face sheet 20 is removed from label assembly 10, to expose tearable line 44. Once tearable line 44 is exposed, label assembly 10 can be easily separated into portion 11 and portion 12, or more portions.

Any suitable force can be applied to lift tab 21 and/or strip 22, to remove strip 22. With many label assemblies 10, fingers of a user clamp together to grip and pull lift tab 21 and/or strip 22. The force moves lift tab 21 and/or strip 22 in a direction away from label assembly 10.

Tearable line 42 and/or tearable line 44 can be separated along any suitable tearable line or line of weakening. Any suitable die cut line provides a sharp and clean edge along tearable line 42 and/or tearable line 44.

Before label assembly 10 is separated, label assembly 10 is routed through a printer, such as a laser printing device, an ink jet printing device, or any other suitable printing device that can print text upon face sheet 20 of label assembly 10.

When first routed through the printer, print is applied to portion 11 of label assembly 10. After label assembly 10 is divided into two or more portions 11 and 12, a second portion, such as portion 12 shown in FIG. 1, which represents less than the entire label assembly 10 is again routed through a printer and print is applied to the second portion, such as portion 12 shown in FIG. 1.

According to one embodiment of this invention, a method for printing a plurality of portions of label assembly 10, begins with routing label assembly 10 through a printer and printing on a first portion of label assembly 10. The first portion is separated from a second portion of label assembly 10, along at least one tearable line 42 of face sheet 20 and along tearable line 44 of back sheet 30, wherein each tearable line 42 is offset with respect to tearable line 44. The second portion of label assembly 10 is then routed through a printer and print is applied to the second portion of label assembly 10. According to the method of this invention, more than two portions of label assembly 10 can be separated and/or routed through the printer.

FIG. 1 shows portion 11 having two labels 13, with a first shape on a first side and a second shape on a second side. Also as shown in FIG. 1, portion 12 has two labels 13, with the second shape on the first side and the first shape on the second side. For example, portion 11 can be inserted into a printer, in a direction of the arrow shown on portion 11. Label assembly 10 can be separated and then portion 12 can be routed through a printer, in a direction of the arrow shown on portion 12, to print on portion 12.

The design and shape of label assembly 10, the type of tearable line 42 and/or tearable line 44, as well as the type of tearable line 42 and/or tearable line 44, can be used to vary the design and structure of label assembly 10. Different layouts of adhesive 25 can be accomplished by different manufacturing processes known to those skilled in the art of label assemblies, which for example can be used to provide a non-adhesive area at or near lift tab 21.

Different materials can be used for face sheet 20, back sheet 30 and/or adhesive 25, which are known to those skilled in the art of label assemblies.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A label assembly comprising:

a face sheet, a back sheet, a layer of an adhesive positioned between said face sheet and said back sheet, said adhesive adhering to said face sheet more than to said back sheet; and a separation line dividing the label assembly into at least two portions, said separation line formed by at least one first tearable line of separation extending across said face sheet and a second tearable line of separation extending across said back sheet, and each said first tearable line of separation being offset with respect to said second tearable line of separation, each said second tearable line of separation corresponding to two said first tearable lines of separation.

2. The label assembly according to claim 1, wherein said face sheet and said back sheet are coextensive with respect to each other.

3. The label assembly according to claim 1, wherein the adhesive layer surrounds a first area between said face sheet and said back sheet, and said at least one first tearable line of separation intersects said first area.

4. The label assembly according to claim 3, wherein a lift tab of said face sheet at least partially covers said first area.

5. The label assembly according to claim 1, wherein said at least two portions are separable from each other.

6. The label assembly according to claim 1, wherein a first path of each said first tearable line of separation generally follows a second path of said second tearable line of separation.

7. The label assembly according to claim 6, wherein said first path and said second path are linear.

8. The label assembly according to claim 1, wherein said first tearable line of separation and said second tearable line of separation extend from a first edge portion of the label assembly to a second edge portion of the label assembly.

9. The label assembly according to claim 1, wherein each said second tearable line of separation is positioned between said two corresponding first tearable lines of separation.

10. The label assembly according to claim 9, wherein said face sheet has a removable strip between said two corresponding first tearable lines of separation.

11. The label assembly according to claim 1, wherein each said first tearable line of separation comprises at least one of a die cut line, a laser die cut line, a score cut line, a perforation line, a microperforation line, a chemically etched line, a liquid etched line and a gas etched line.

12. The label assembly according to claim 1, wherein each said second tearable line of separation comprises at least one of a die cut line, a laser die cut line, a score cut line, a perforation line, a microperforation line, a chemically etched line, a liquid etched line and a gas etched line.

13. The label assembly according to claim 1, wherein said adhesive surrounds said at least one first tearable line of separation.

14. A label assembly comprising:

a face sheet, a back sheet, a layer of an adhesive positioned between said face sheet and said back sheet, said adhesive adhering to said face sheet more than to said back sheet; and a separation line dividing the label assembly into at least two portions, said separation line formed by at least one first tearable line of separation extending across said face sheet and a second tearable line of separation extending across said back sheet, and each said first tearable line of separation being offset with respect to said second tearable line of separation, a first path of each said first tearable line of separation generally following a second path of said second tearable line of separation, said first path and said second path being non-linear.

15. A label assembly comprising:

a face sheet, a back sheet, a layer of an adhesive positioned between said face sheet and said back sheet, said adhesive adhering to said face sheet more than to said back sheet; and a separation line dividing the label assembly into at least two portions, said separation line formed by at least one first tearable line of separation extending across said face sheet and a second tearable line of separation extending across said back sheet, each said first tearable line of separation being offset with respect to said second tearable line of separation, and the adhesive layer having an edge portion offset with respect to said separation line.

16. A label assembly comprising:

a face sheet, a back sheet, a layer of an adhesive positioned between said face sheet and said back sheet, said adhesive adhering to said face sheet more than to said back sheet; and a separation line dividing the label assembly into at least two portions, said separation line formed by at least one first tearable line of separation extending across said face sheet and a second tearable line of separation extending across said back sheet, and each said first tearable line of separation being offset with respect to said second tearable line of separation, each said first tearable line of separation terminating short of at least one of a first edge portion of said label assembly and a second edge portion of said label assembly.

* * * * *

US006860050C1

(12) INTER PARTES REEXAMINATION CERTIFICATE (1117th)

United States Patent
Flynn et al.

(10) Number: US 6,860,050 C1
(45) Certificate Issued: May 28, 2015

(54) APPARATUS FOR SEPARATING LABEL ASSEMBLY

(75) Inventors: Timothy J. Flynn, Key Largo, FL (US); Thomas E. Flynn, Crystal Lake, IL (US); Patrick J. Flynn, Redlands, CA (US)

(73) Assignee: CONTINENTAL DATALABEL, INC., Elgin, IL (US)

Reexamination Request:
No. 95/001,608, Apr. 21, 2011

Reexamination Certificate for:

| | |
|---|---|
| Patent No.: | **6,860,050** |
| Issued: | **Mar. 1, 2005** |
| Appl. No.: | **10/390,339** |
| Filed: | **Mar. 17, 2003** |

(51) Int. Cl.
*G09F 3/10* (2006.01)

(52) U.S. Cl.
CPC ..... *G09F 3/10* (2013.01)

(58) Field of Classification Search
None
See application file for complete search history.

(56) References Cited

To view the complete listing of prior art documents cited during the proceeding for Reexamination Control Number 95/001,608, please refer to the USPTO's public Patent Application Information Retrieval (PAIR) system under the Display References tab.

*Primary Examiner* — Cary Wehner

(57) ABSTRACT

A label assembly having a face sheet adhered to a back sheet. A separation line includes at least one first tearable line of separation extending across the face sheet and a second tearable line of separation extending across the back sheet. Each first tearable line of separation is offset with respect to the second tearable line of separation. In a method for printing a plurality of portions of the label assembly, the label assembly is routed through a printer and print is applied to a first portion of the label assembly. The first portion is separated from a second portion and the second portion is routed through a printer and print is applied to the second portion of the label assembly.

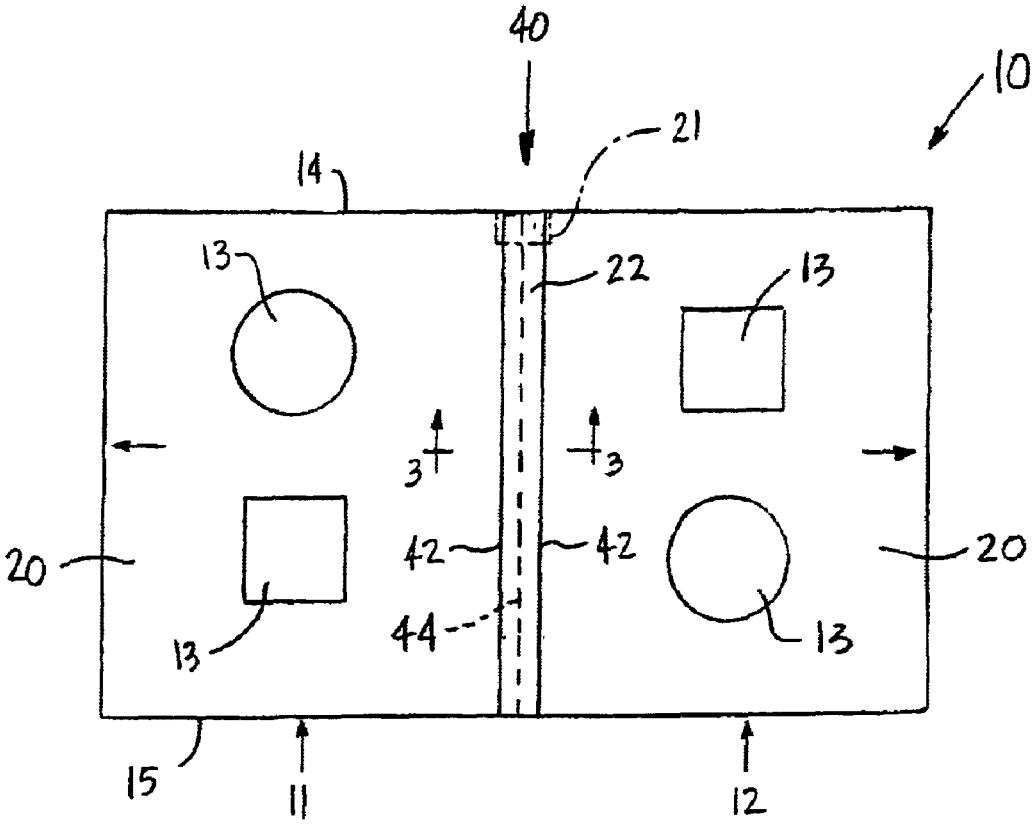

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-16 are cancelled.

* * * * *